US011363874B2

(12) United States Patent
Yajima et al.

(10) Patent No.: US 11,363,874 B2
(45) Date of Patent: Jun. 21, 2022

(54) COSMETIC APPLICATOR

(71) Applicant: SHISEIDO COMPANY, LTD., Tokyo (JP)

(72) Inventors: Isao Yajima, Kanagawa (JP); Chie Takagi, Kanagawa (JP)

(73) Assignee: SHISEIDO COMPANY, LTD., Tokyo (JP)

( * ) Notice: Subject to any disclaimer, the term of this patent is extended or adjusted under 35 U.S.C. 154(b) by 345 days.

(21) Appl. No.: 16/476,805

(22) PCT Filed: Dec. 19, 2017

(86) PCT No.: PCT/JP2017/045449

§ 371 (c)(1),
(2) Date: Jul. 9, 2019

(87) PCT Pub. No.: WO2018/131396

PCT Pub. Date: Jul. 19, 2018

(65) Prior Publication Data

US 2019/0374005 A1 Dec. 12, 2019

(30) Foreign Application Priority Data

Jan. 10, 2017 (JP) ..... JP2017-001557

(51) Int. Cl.
*A45D 34/04* (2006.01)
*A45D 40/26* (2006.01)

(52) U.S. Cl.
CPC ..... *A45D 34/045* (2013.01); *A45D 34/043* (2013.01); *A45D 40/264* (2013.01); *A45D 40/265* (2013.01)

(58) Field of Classification Search
CPC .... A45D 34/04; A45D 34/041; A45D 34/042; A45D 34/043; A45D 34/045;
(Continued)

(56) References Cited

U.S. PATENT DOCUMENTS 5,224,787 A * 7/1993 Vasas ..... A45D 40/265 132/218
6,033,143 A 3/2000 Gueret
(Continued)

FOREIGN PATENT DOCUMENTS

AR 013762 A1 1/2001
BR 9502326 A 6/1996
(Continued)

OTHER PUBLICATIONS

International Search Report dated Apr. 3, 2018 filed in PCT/JP2017/045449.

*Primary Examiner* — David J Walczak
(74) *Attorney, Agent, or Firm* — Rankin, Hill & Clark LLP

(57) ABSTRACT

A cosmetic applicator is capable of reliably scooping an appropriate amount of a cosmetic, coming into firm contact with an application area such as a lip, and evenly spreading the cosmetic over the application area. A cosmetic applicator 1 includes a substantially flat application member 3 extending from a tip of a rod-like support member 2 at an angle $\theta_1$ of 0 to 45 degrees with respect to an axial center of the support member, wherein the application member 3 is formed in a spiral shape in a direction in which the application member 3 extends, and a flat surface of a front end portion of the application member 3 is at an angle $\theta_2$ of 10 to 120 degrees with respect to a flat surface of a rear end portion of the application member.

2 Claims, 10 Drawing Sheets

(58) Field of Classification Search
CPC .... A45D 34/046; A45D 34/047; A45D 40/26; A45D 40/161; A45D 40/262; A45D 40/264; A45D 40/265; A45D 40/267; A45D 40/268
USPC ..... 401/121, 122, 130; D28/76, 80, 83–85
See application file for complete search history.

(56) References Cited

U.S. PATENT DOCUMENTS

| | | | | |
|---|---|---|---|---|
| 6,220,254 | B1 | 4/2001 | Gueret | |
| 6,341,912 | B1 | 1/2002 | Gueret | |
| D641,929 | S * | 7/2011 | Poletto | D28/76 |
| D739,081 | S * | 9/2015 | James | D28/76 |
| 2004/0161285 | A1* | 8/2004 | Gueret | A45D 34/04 401/130 |
| 2007/0020027 | A1* | 1/2007 | Gueret | A45D 40/262 401/130 |
| 2007/0181143 | A1* | 8/2007 | Montoli | A45D 34/04 132/320 |
| 2010/0294299 | A1 | 11/2010 | Gueret | |
| 2013/0074868 | A1 | 3/2013 | Shimamura | |
| 2013/0276817 | A1 | 10/2013 | Holloway et al. | |
| 2014/0348566 | A1* | 11/2014 | Uehara | A45D 40/267 401/126 |
| 2015/0374100 | A1* | 12/2015 | Wilson | A46B 3/06 401/129 |

FOREIGN PATENT DOCUMENTS

| | | | |
|---|---|---|---|
| BR | PI1002532 | A2 | 3/2012 |
| CA | 2152987 | A1 | 1/1996 |
| CA | 2251997 | C | 3/2006 |
| CN | 1217172 | A | 5/1999 |
| CN | 101878990 | A | 11/2010 |
| CN | 102858201 | A | 1/2013 |
| DE | 69507667 | T2 | 6/1999 |
| DE | 69803739 | T2 | 8/2002 |
| EP | 0693263 | A1 | 1/1996 |
| EP | 0916282 | A1 | 5/1999 |
| EP | 2229840 | A1 | 9/2010 |
| EP | 2564725 | A1 | 3/2013 |
| EP | 2786671 | A1 | 10/2014 |
| ES | 2129776 | T3 | 6/1999 |
| ES | 2172102 | T3 | 9/2002 |
| ES | 2546292 | T3 | 9/2015 |
| ES | 2559518 | T3 | 2/2016 |
| FR | 2722381 | A1 | 1/1996 |
| FR | 2771077 | A1 | 5/1999 |
| FR | 2943226 | A1 | 9/2010 |
| FR | 3012946 | A1 | 5/2015 |
| JP | H0838248 | A | 2/1996 |
| JP | H11222274 | A | 8/1999 |
| JP | 200117234 | A | 1/2001 |
| JP | 200812177 | A | 1/2008 |
| JP | 2010221040 | A | 10/2010 |
| JP | 2011229655 | A | 11/2011 |
| JP | 201255548 | A | 3/2012 |
| JP | 2014121361 | A | 7/2014 |
| KR | 2012-0123598 | A | 11/2012 |
| TW | 201201739 | A1 | 1/2012 |
| WO | 2011136078 | A1 | 11/2011 |
| WO | 2015071818 | A1 | 5/2015 |

* cited by examiner

COSMETIC APPLICATOR

TECHNICAL FIELD

The present invention relates to a cosmetic applicator for applying cosmetics such as lipsticks, lip glosses, and concealers.

BACKGROUND ART

In recent years, among cosmetics such as lipsticks and lip glosses, the ones that achieve cosmetic effects such as giving a glossy luster to the lips to create three-dimensional lip looks have been popular. Such cosmetics are typically in the form of liquids, pastes, or gels. Thus, a cosmetic container typically used includes a container body capable of reliably accommodating a cosmetic without causing leakage thereof and a cap provided internally with a spatula-shaped applicator that can be inserted into the container body to scoop out the cosmetic.

When the applicator that has been pulled out has an excessive amount of cosmetic attached thereto, the cosmetic may spread out of a lip or the like to an unintended area, affecting a makeup maneuver. For this reason, an outlet of the container body of the cosmetic container usually has a scraper part where the applicator is rubbed against to scrape off an excess cosmetic.

However, it is difficult to adjust the amount of cosmetic to be scraped off with the scraper part, as the amount of cosmetic to be scraped off varies depending on the angle of the applicator being pulled out of the container body or how fast the applicator is pulled out. Therefore, the amount of cosmetic attached to the pulled out applicator is not necessarily an appropriate amount, and the finish of a makeup look is not always satisfactory. In addition, when a small amount of cosmetic is scooped, the applicator may need to be placed in and out of the container body to repeatedly scoop the cosmetic, which not only is a hassle in wearing makeup but also results in poor usability of the applicator. Moreover, when the applicator is used on lips, and if a surface of the applicator does not come into firm contact with the lips adequately, the cosmetic cannot be applied evenly to the lips, resulting in unsatisfactory cosmetic effects.

In view of the foregoing facts, it is important for such applicator for applying a cosmetic to be able to not only reliably scoop an appropriate amount of a cosmetic but also come into firm contact with an application area and evenly apply the cosmetic thereto, and it is desirable to develop cosmetic applicators capable of accomplishing these tasks.

CITATION LIST

Patent Literature

[PTL 1] Japanese Patent Application Laid-open No. 2012-55548

SUMMARY OF INVENTION

Technical Problem

An object of the present invention is to provide a cosmetic applicator capable of reliably scooping an appropriate amount of a cosmetic, coming into firm contact with an application area such as a lip, and evenly spreading the cosmetic over the application area.

Solution to Problem

As a result of studies to achieve the foregoing object, the inventors of the present invention have discovered an applicator which includes a substantially flat application member extending from a tip of a rod-like support member along an axial center of the support member or at a predetermined angle with respect to the axial center, wherein an inclined surface can be formed on the application member by forming the application member in a spiral shape in a direction in which the application member extends, an appropriate amount of a cosmetic can reliably be scooped by the inclined surface, and the application member can come into firm contact with an application area such as a lip to evenly spread the cosmetic over the application area. As a result, the inventors have completed the present invention.

Specifically, the present invention is a cosmetic applicator wherein the substantially flat application member, which extends from the tip of the rod-like support member at an angle of 0 to 45 degrees with respect to the axial center of the support member, is formed in a spiral shape in the direction in which the application member extends.

Furthermore, the present invention is a cosmetic applicator wherein a flat surface of a front end portion of the application member is at an angle of 10 to 120 degrees with respect to a flat surface of a rear end portion of the application member.

Moreover, the present invention is a cosmetic applicator wherein a surface of the application member is subjected to electrostatic flocking.

Advantageous Effects of Invention

The present invention can realize a cosmetic applicator capable of reliably scooping an appropriate amount of a cosmetic, coming into firm contact with an application area such as a lip, evenly spreading the cosmetic over the application area, and thereby achieving excellent cosmetic effects.

DESCRIPTION OF EMBODIMENTS

Embodiments according to the present invention are now described hereinafter, but the present invention is not limited by the examples illustrated in the embodiments.

Figure 1:
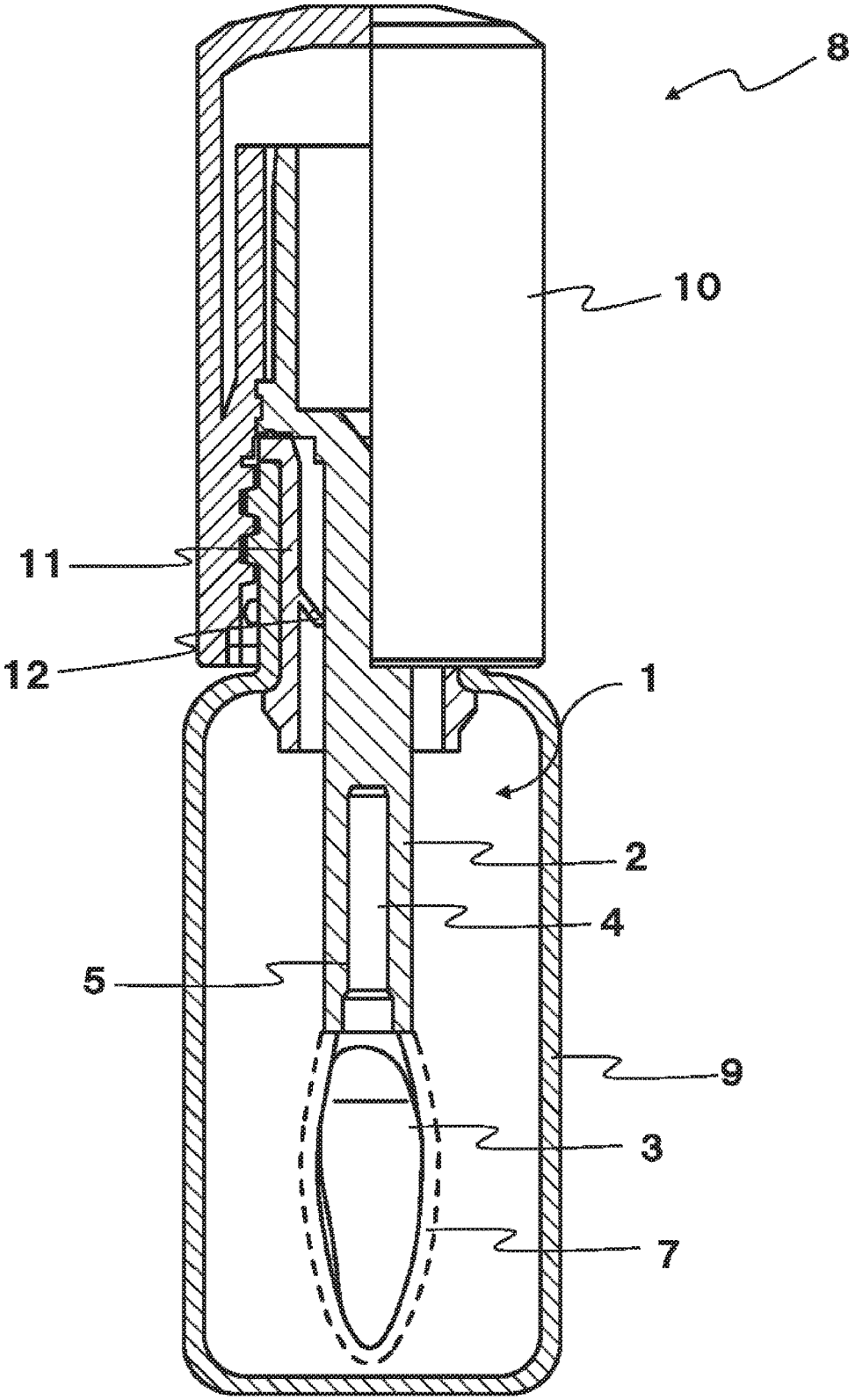
FIG. 1 is a structural drawing (partial cross-sectional view) of a cosmetic container incorporating a cosmetic applicator.

FIG. 1 shows a structure of a cosmetic container incorporating a cosmetic applicator of the present invention. A cosmetic container (8) includes a container body (9) that is filled with a cosmetic, and a cap (10). The cap (10) is provided with a cosmetic applicator (1) for picking up the cosmetic and applying the cosmetic to a lip. The cosmetic applicator (1) is configured by joining a support member (2) and an application member (3), and an end portion of the support member (2), to which the application member is not joined, is joined to the cap (10). The support member (2) and the application member (3) are joined to each other by inserting and fixing a retained portion (4), which is provided integrally on an end of the application member (3), into a retaining hole (5) provided at the end portion of the support member (2). The cosmetic applicator (1) is fitted to the cap (10) such that, when the cap (10) is twisted onto a mouth portion of the container body (9), the cosmetic applicator (1) becomes immersed in the cosmetic filling the container body (9). Note that the cosmetic applicator of the present invention can not only be incorporated in a cosmetic container but also be used as an applicator for applying a cosmetic independently.

For the application member (3), a material with moderate elasticity needs to be selected in order to realize good touch to an application area such as a lip and achieve a smooth makeup maneuver. Also, since the application member (3) is a part that constantly comes into contact with the cosmetic, the material needs to be chemically stable and needs to not interact with the cosmetic. Therefore, it is preferred that the material for forming the application member (3) be an elastomer resin, and thermoplastic elastomer, for example, is preferred as the elastomer resin.

To facilitate the scooping of the cosmetic and the application of the cosmetic to the lip, it is preferred that the maximum width of the application member (3) be approximately 3 to 8 mm, the length be approximately 10 to 20 mm, and the thickness be approximately 0.5 to 2.0 mm, but dimensions of the application member (3) are not limited thereto, depending on the cosmetic applied.

An outlet of the container body (9) is provided with a scraper part (11). When pulling the cosmetic applicator (1) out of the container body (9), an excess cosmetic attached to the support member (2) and the application member (3) is scraped off by an inner hole edge (12) of the scraper part. Because the cap is turned to pull out the cosmetic applicator, the inner hole edge (12) of the scraper part (11) has a circular shape with no directionality. Since the scraper part (11) needs to have elasticity, rubber or elastomer such as NBR (nitrile butadiene rubber) or silicon is generally used as a material of the scraper part (11).

When applying the cosmetic using the cosmetic applicator (1), the cosmetic applicator (1) is pulled out of the container body (9), the excess cosmetic attached to a surface of the application member (3) is scraped off with the scraper part (11), and a certain amount of the cosmetic to be carried on the surface of the application member is applied to the application area such as a lip by bringing the application member into firm contact with the application area while operating the cosmetic applicator (1).

Figure 2:
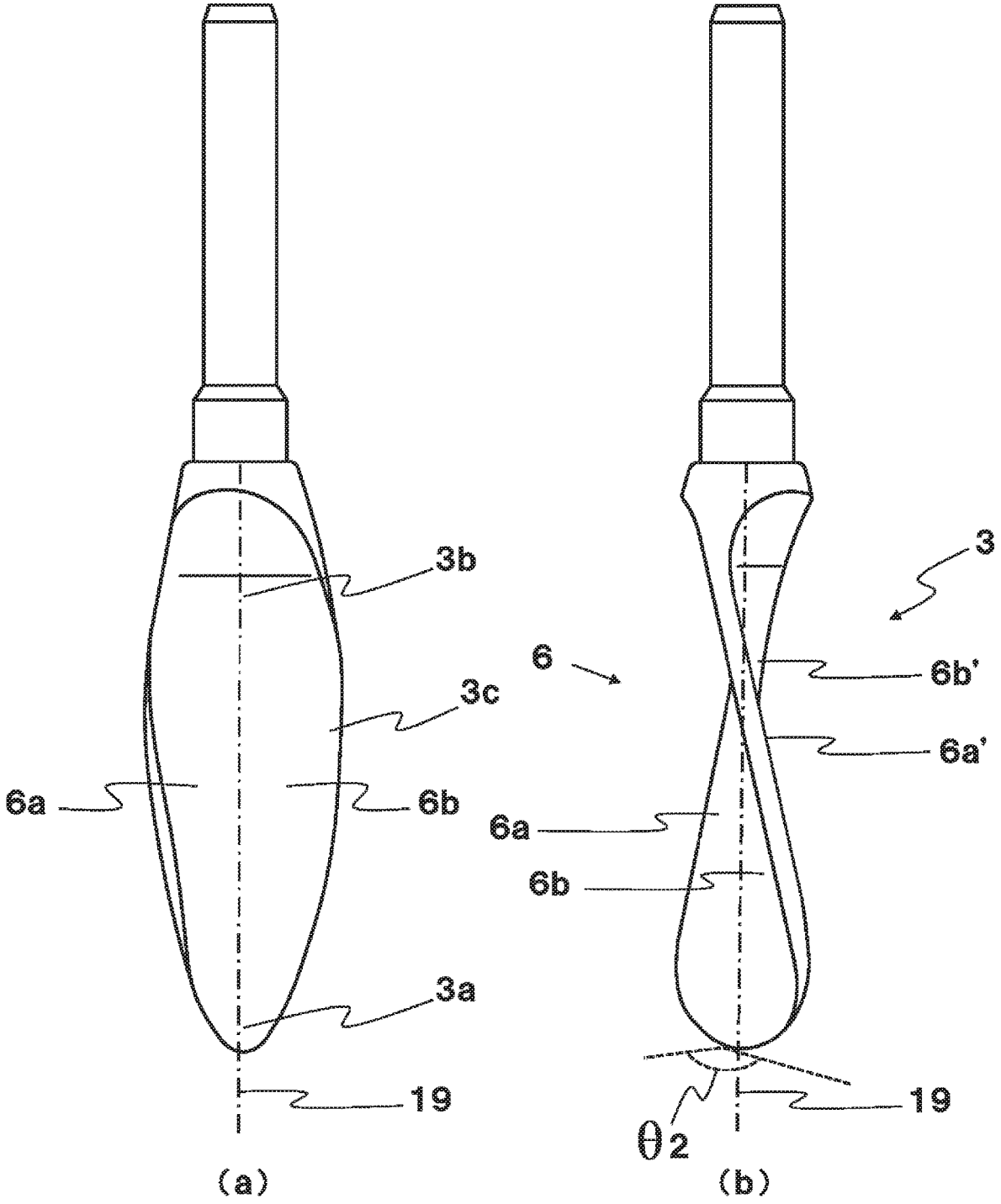
FIG. 2 is an external view ((a) front view, (b) side view) of an application member (first embodiment).

The cosmetic applicator (1) has the substantially flat application member (3) extending from a tip of the rod-like support member along an axial center of the support member or at a predetermined angle with respect to the axial center. The application member (3) is formed in a spiral shape in a direction in which the application member (3) extends. Thus, inclined surfaces (6*a*, 6*a*', 6*b*, 6*b*') each having a predetermined inclination angle with respect to a central axis (19) of the spiral are formed on front and rear surfaces of the application member (3) (FIG. 2). Specifically, on the front and rear surfaces of the application member (3), respectively, the inclined surfaces (6*a*, 6*a*') facing the outlet of the container body and the inclined surfaces (6*b*, 6*b*') facing a bottom portion of the container body are formed on the left-hand side and the right-hand side of the central axis (19). When applying the cosmetic, the application member (3) is pulled out through the mouth portion of the container body along the central axis (19), and in so doing, the inclined surfaces (6*a*, 6*a*') facing the outlet of the container body easily come into abutment with the scraper part, while the inclined surfaces (6*b*, 6*b*') facing the bottom portion of the container body do not easily come into abutment with the scraper part. For this reason, the amount of the cosmetic carried varies between these inclined surfaces.

When pulling out the application member (3) from the container body (9) along the central axis (19), a large amount of the cosmetic attached to the inclined surfaces (6*a*, 6*a*') facing the outlet of the container body is scraped off at the scraper part, whereas a small amount of the cosmetic attached to the inclined surfaces (6*b*, 6*b*') facing the bottom portion of the container body is scraped off by the scraper part. Therefore, the application member, having a large amount of cosmetic attached thereto, can be pulled out of the container body. Furthermore, between a front end portion (3*a*) of the application member (3) and a rear end portion (3*b*) of the same, the cosmetic is attached to the inclined surfaces (6*b*, 6*b*') facing the bottom portion of the container body. Therefore, when applying the cosmetic to the lip or the like, the cosmetic can be spread easily. In particular, by making the inclination angles (spiral angles) of the inclined surfaces with respect to the central axis (19) constant between the front end portion (3*a*) of the application member (3) and the rear end portion (3*b*), the cosmetic can be attached evenly to the front and rear surfaces of the application member (3) from the front end portion (3*a*) through the rear end portion (3*b*), enabling easy application of the cosmetic to the lip or the like.

As described above, by pulling the application member (3) out of the container body (9) along the central axis (19), a predetermined amount of the cosmetic can reliably be carried on the inclined surfaces (6*b*, 6*b*') located on the front and rear surfaces of the application member (3) and facing the bottom portion of the container body. Thus, the cosmetic can be prevented from becoming insufficient during the makeup maneuver, thereby eliminating the need to repeatedly scoop the cosmetic out of the container body (9). Moreover, since the inclined surfaces (6*b*, 6*b*') are so shaped that the application member can easily come into firm contact with the lip or the like, the cosmetic can be spread over the lip or the like evenly while having a flat surface of the application member (3) in firm contact with the lip or the like.

As a result of forming the application member (3) in a spiral shape, the inclined surfaces (6*a*, 6*a*', 6*b*, 6*b*') can be provided from the front end portion of the application portion through the rear end portion of the same while keeping the thickness of the application member approximately uniform (see FIG. 2). The application member is normally produced by injection molding of a synthetic resin, and the entire application member can be provided with elasticity by making the thickness of the application member approximately uniform. Therefore, when applying the cosmetic to the lip or the like, the application member can easily come into firm contact with the lip or the like, achieving even application, obtaining a soft feel of the application member to the lip or the like, and improving the usability of the application member. Although depending on the type of the resin used for forming the application member, it is preferred that the length of the application member be approximately 5 to 40 times the thickness of the application member and that the maximum width of the application member be approximately 1.5 to 16 times the thickness of the application member, when rubber or elastomer such as NBR (nitrile butadiene rubber) is used.

Figure 4:
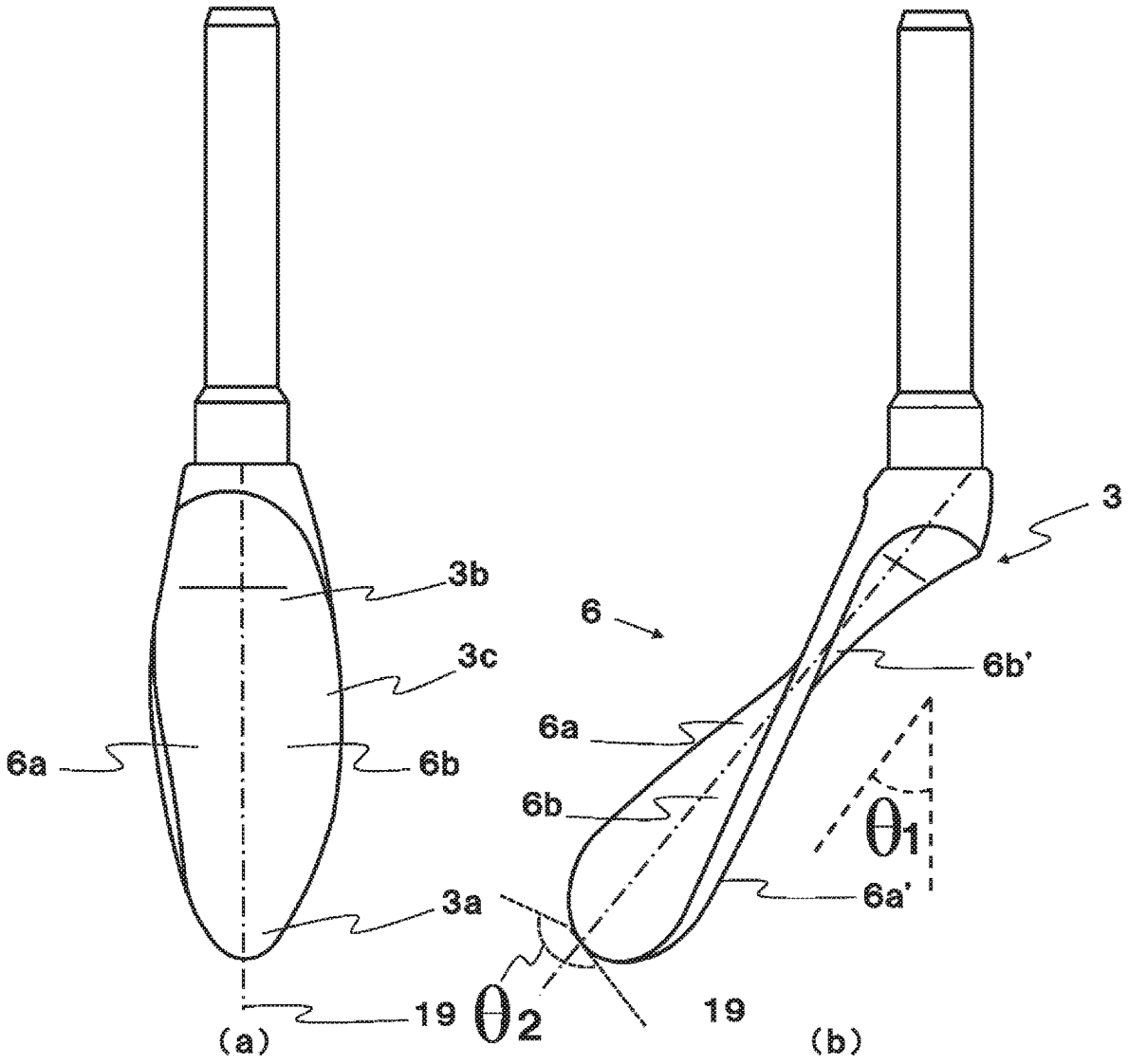
FIG. 4 is an external view ((a) front view, (b) side view) of the application member (second embodiment).

It is preferred that an angle $\theta_1$ of the substantially flat application member (3) with respect to the axial center of the support member (2) be 0 to 45 degrees (FIG. 4), the application member extending from the tip of the support member (2). When holding the cap (or the support member) in a hand and applying the cosmetic, adjusting this angle $\theta_1$ can allow the application member (3) to come into firm contact with the lip or the like, facilitating the application of the cosmetic to the lip or the like. In view of the fact that the angle $\theta_1$ greater than 45 degrees may not only cause the application member to become stuck at the mouth portion of the container body, which makes it difficult for the application member to be pulled out of the container body, but also cause the hand holding the applicator to have to tilt significantly when bringing the application member into firm contact with the lip or the like, which disrupts the smooth makeup maneuver, it is preferred that the angle $\theta_1$ be equal to or less than 45 degrees.

The spiral-shaped application member (3) is preferably formed in a twisted shape such that an angle $\theta_2$ of a flat surface of the front end portion (3*a*) of the application member with respect to a flat surface of the rear end portion (3*b*) is 10 to 120 degrees. By twisting the flat surface of the front end portion (3*a*) within this angular range, the inclination angles of the inclined surfaces (6*a*, 6*a*', 6*b*, 6*b*') with respect to the central axis (19) can be adjusted, and thereby the amount of the cosmetic to be carried can be adjusted. In addition, so long as the angle $\theta_2$ is in the range of 10 to 120 degrees, the cosmetic applicator can reliably be brought into firm contact with a three-dimensionally curved surface of the lip or the like without changing the way the cosmetic applicator is held. If the angle $\theta_2$ is smaller than 10 degrees, the inclined surfaces cannot carry a sufficient amount of cosmetic, but the angle $\theta_2$ larger than 120 degrees lowers the adhesion of the application member to the lip or the like, thereby making it difficult to evenly spread the cosmetic. In order to carry an even more sufficient amount of cosmetic, it is particularly preferred that the angle $\theta_2$ be 60 to 120 degrees and that the angle of a flat surface of a widest portion (3*c*) with respect to the flat surface of the rear end portion (3*b*) be 5 to 80 degrees.

Figure 5:
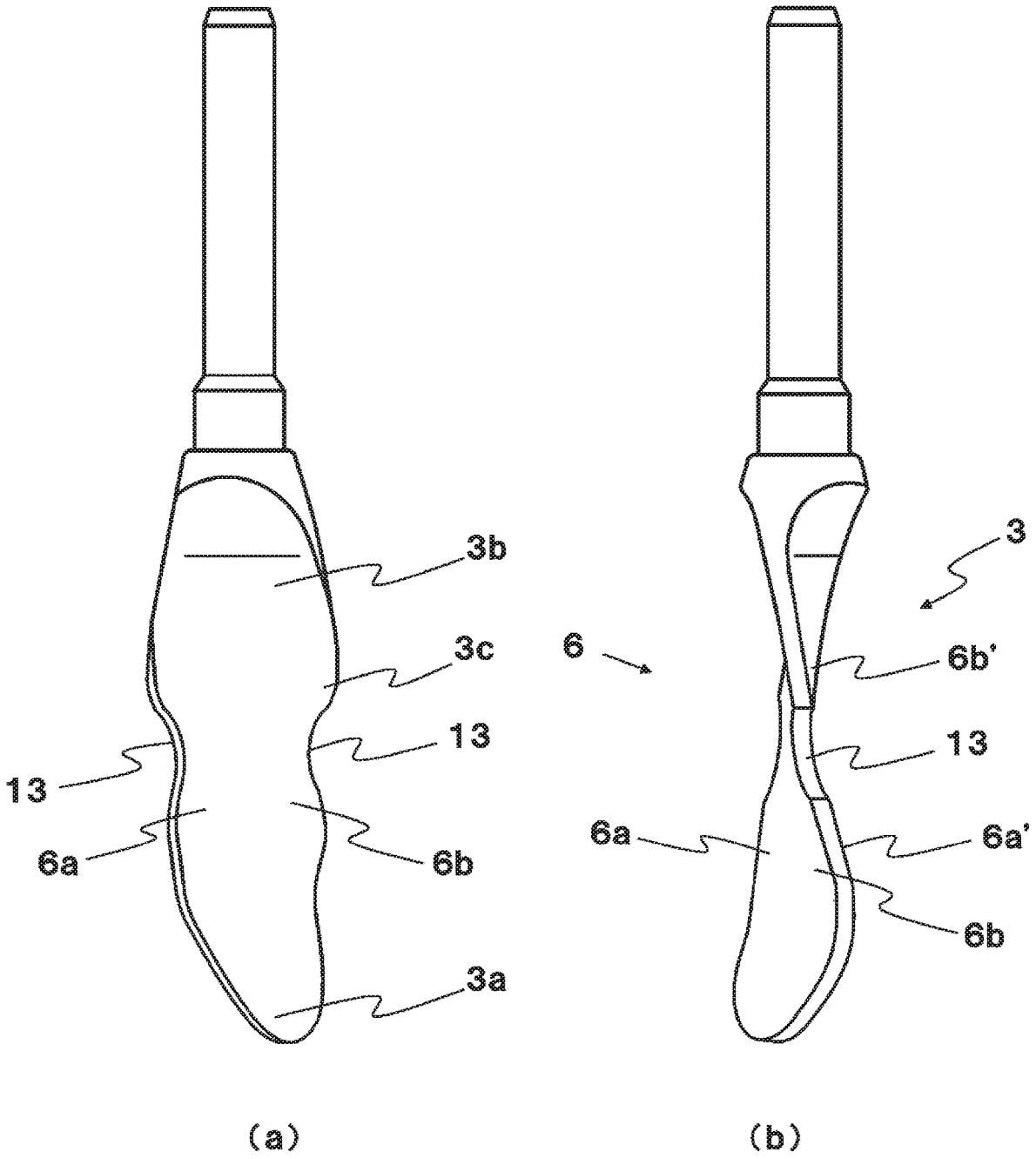
FIG. 5 is an external view ((a) front view, (b) side view) of the application member (third embodiment).
Figure 6:
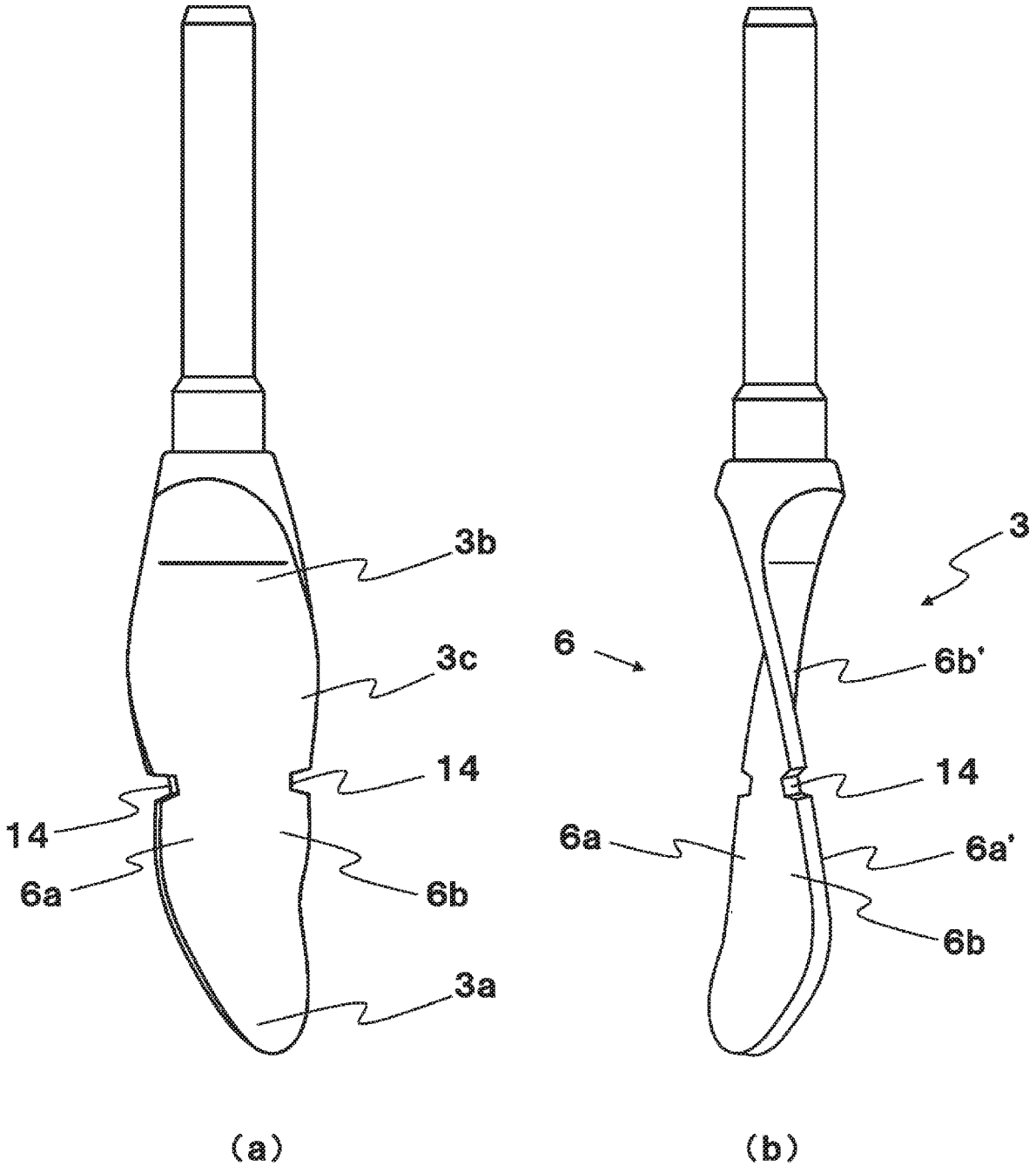
FIG. 6 is an external view of an external view ((a) front view, (b) side view) of the application member (fourth embodiment).

A part of a side surface of the application member can be provided with an arc-shaped notch portion (13) as shown in FIG. 5 or a substantially rectangular C-shaped notch portion (14) as shown in FIG. 6. Providing such notch portions can enable the cosmetic attached thereto to be taken out of the container body without being scraped off on the scraper part.

Figure 7:
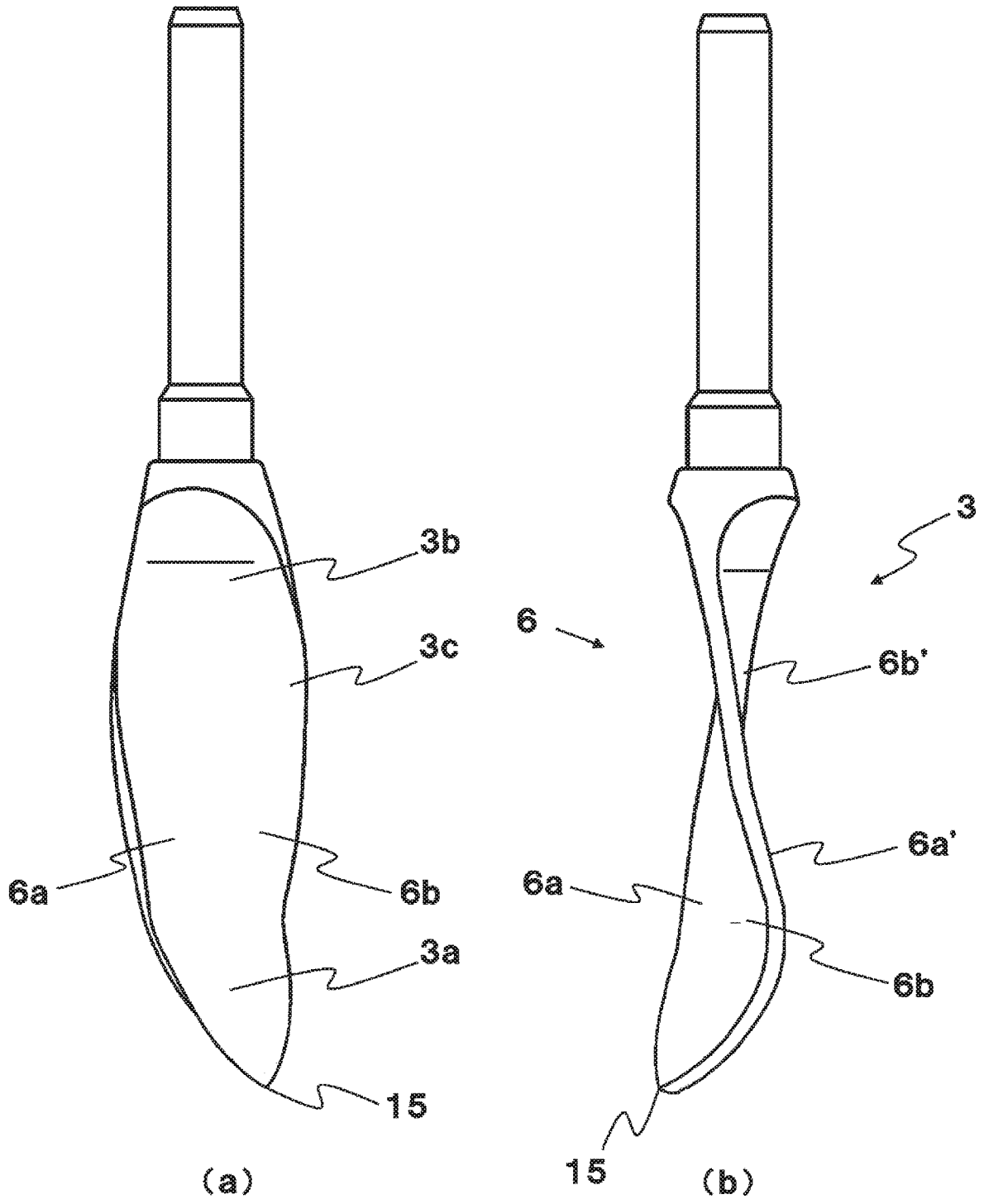
FIG. 7 is an external view ((a) front view, (b) side view) of the application member (fifth embodiment).

Moreover, the front end portion (3*a*) of the application member can be formed into a pointy shape, as shown in FIG. 7. The resultant pointy portion (15) may not only be disposed in the center of the front end portion (3*a*) but also in a position shifted to the left or the right. Providing the pointy portion (15) can facilitate the application of the cosmetic to fine parts and make the makeup maneuver smooth. To further facilitate the makeup maneuver, the pointy portion (15) may be shaped thin.

Figure 8:
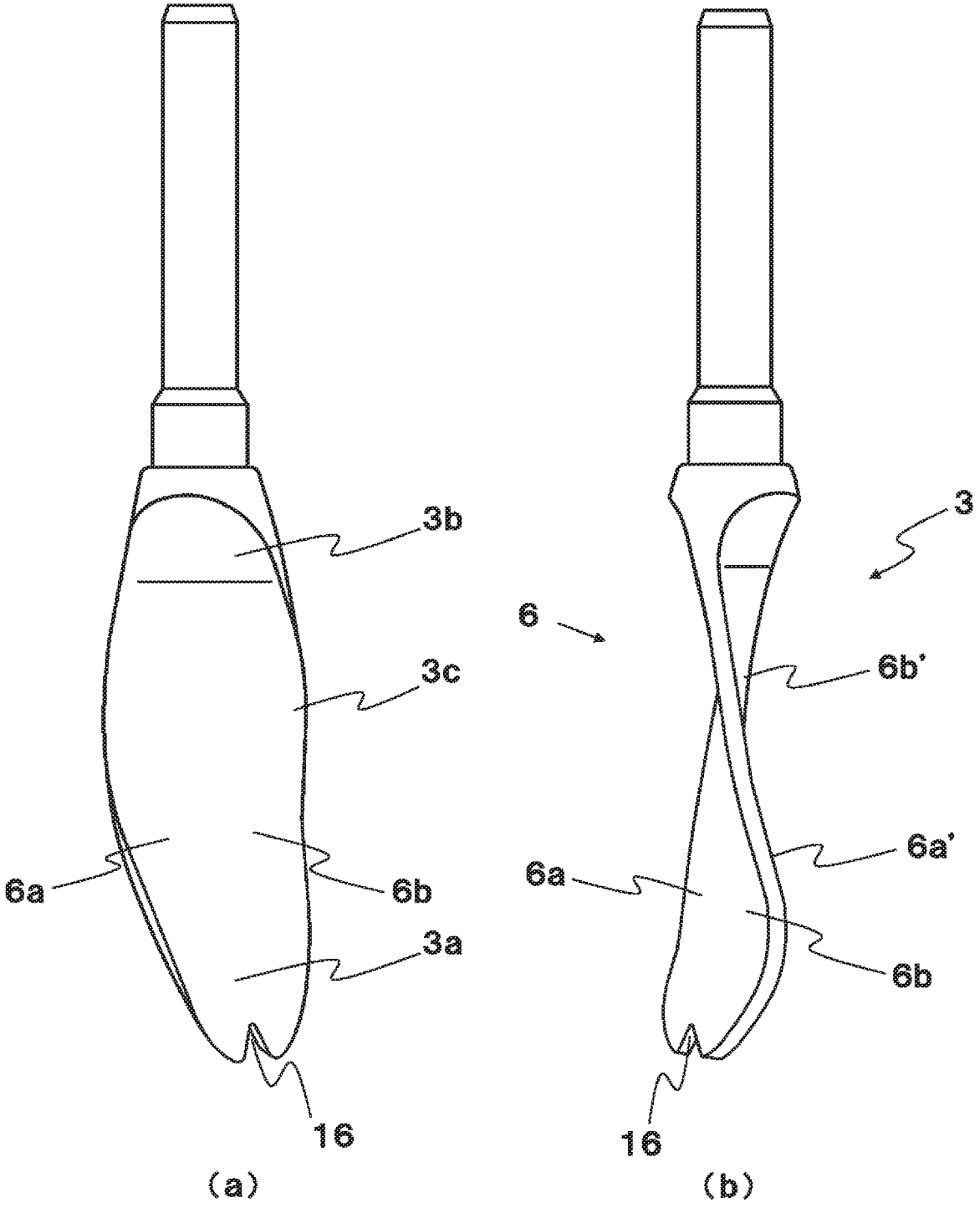
FIG. 8 is an external view ((a) front view, (b) side view) of the application member (sixth embodiment).

As shown in FIG. 8, a part of the front end portion (3*a*) of the application member can be notched and forked into a substantially V-shape. By providing this notch portion, the cosmetic can be carried on the notch portion and applied to finer parts using the forked front end portion.

Figure 9:
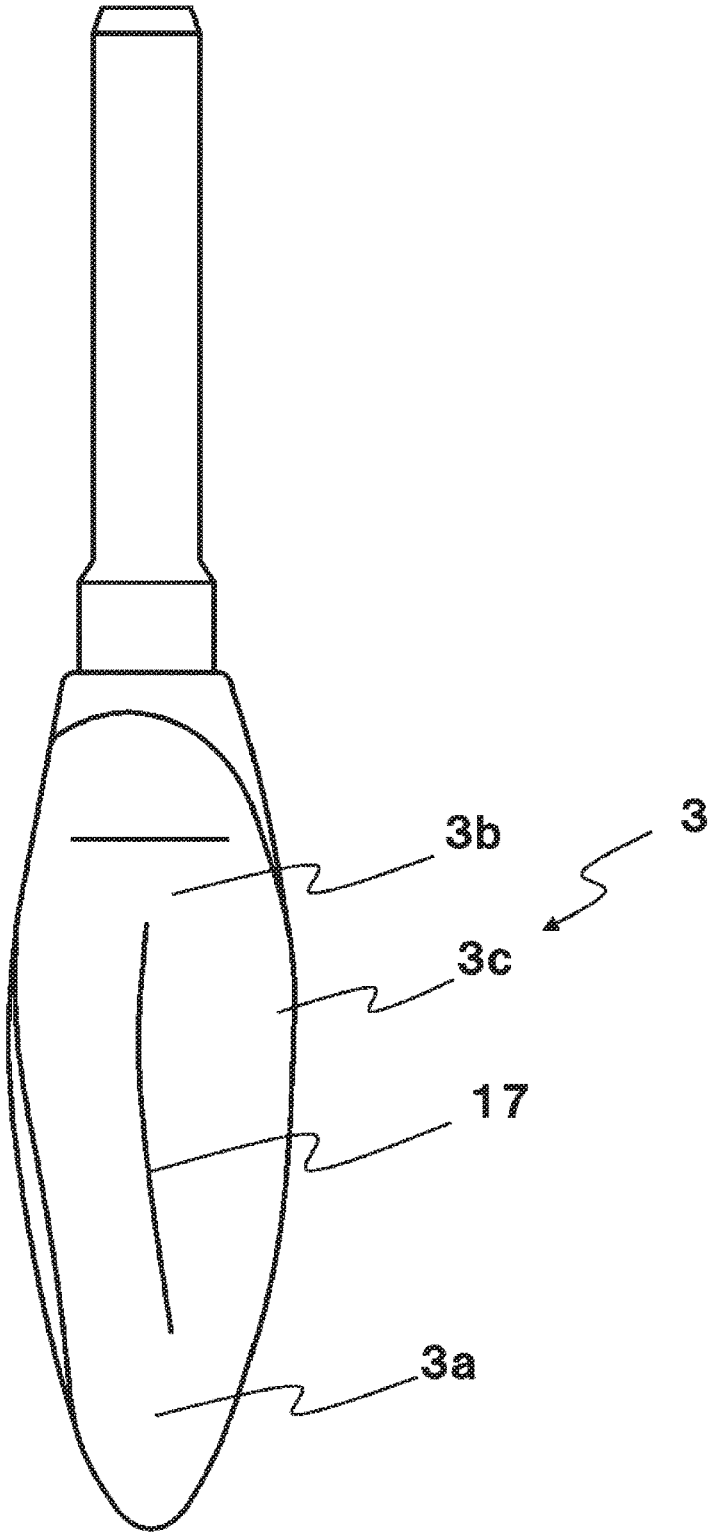
FIG. 9 is a front view of the application member (seventh embodiment).
Figure 10:
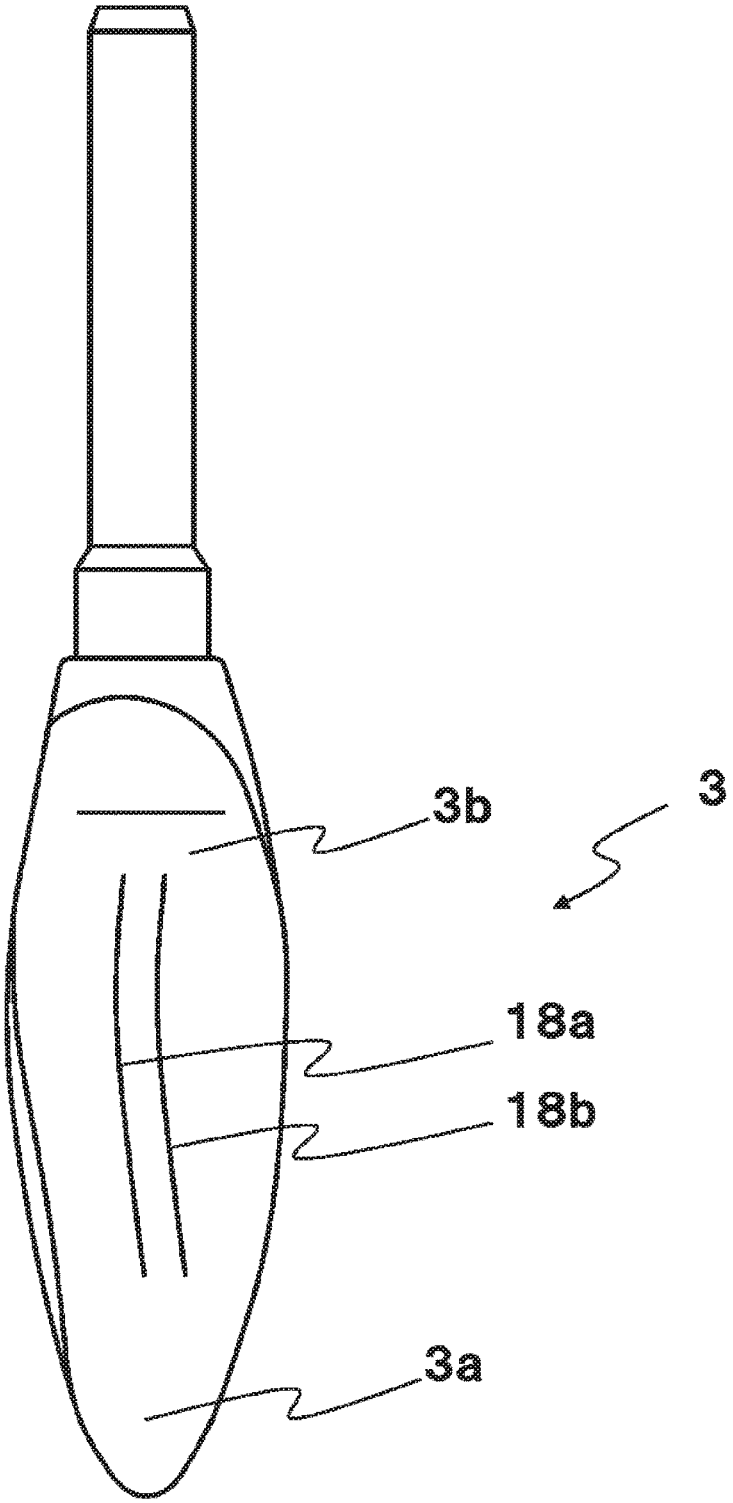
FIG. 10 is a front view of the application member (eighth embodiment).

Furthermore, as shown in FIG. 9, the application member can also be provided with a slit along a longitudinal direction of the application member. The number of slits to be provided may be one, two, or more (FIG. 10). Providing such slits can allow an application member to bow easily, enhancing the adhesion thereof to the lip or the like, and more cosmetic can be carried on these slit portions.

Figure 3:
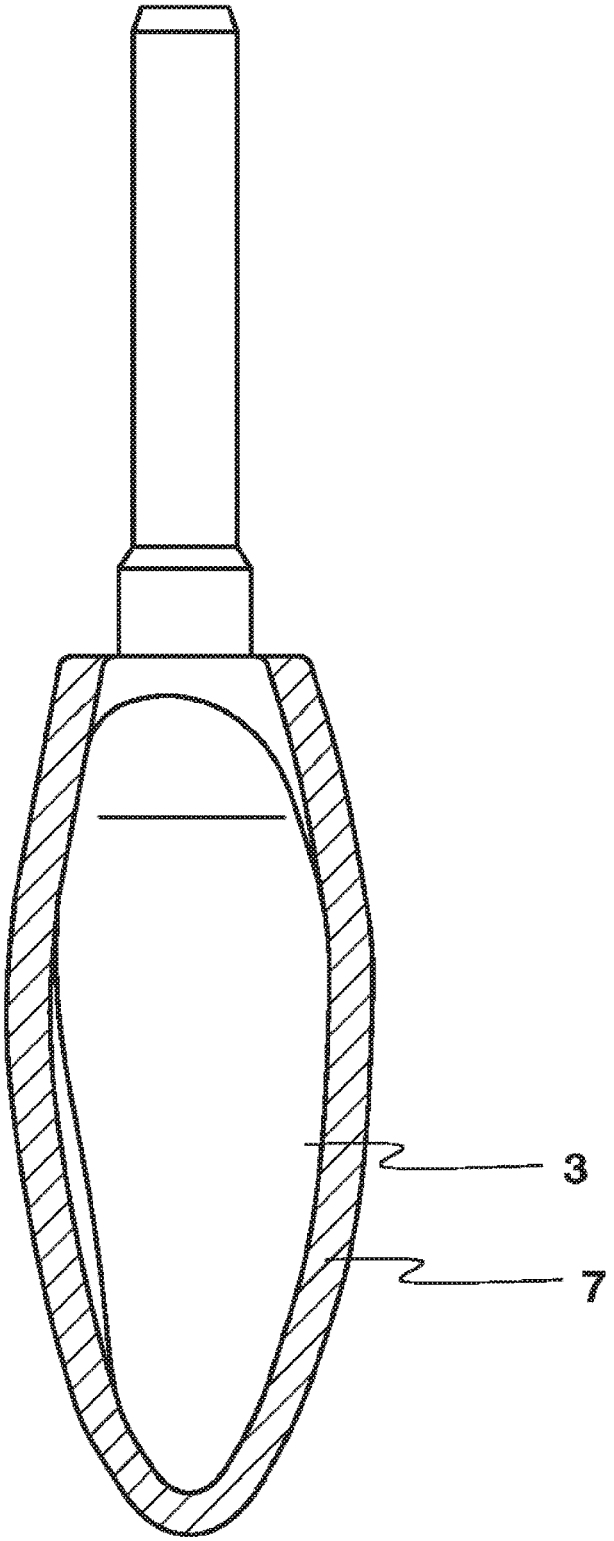
FIG. 3 is an external view (partial cross-sectional view) of the application member subjected to flocking.

The surface of the application member can be electrostatically flocked so that the cosmetic can be carried adequately (FIG. 3). By electrostatically flocking the smooth surface of the application member, the cosmetic can be held between hair, allowing the cosmetic to be spread more evenly. The materials and thicknesses of fibers used for electrostatic flocking (flocky finish) are not particularly limited. Therefore, resin fibers such as nylon and polyester having a thickness of approximately 0.5 to 4.0 T (decitex), which are used in general for electrostatically flocking cosmetic tools, can be used. It is favorable that the length of fibers to be deposited is 0.1 to 2.0 mm so that the fibers stand up reliably, allowing the cosmetic to be carried easily. The length of the fibers shorter than 0.1 mm leads to a poor effect of the deposited fibers carrying the cosmetic, whereas the length of the fibers longer than 2.0 mm prevents the deposited fibers from standing up after repeated use, resulting in a reduced amount of cosmetic to be impregnated therein. Note that combining a plurality of types of fibers having different thicknesses, lengths, materials and the like can not only improve liquid impregnation properties and hence the effect of carrying the cosmetic but also adjust the extent in which the deposited fibers stand up, enabling the adjustment of the feeling of use of the application member.

The cosmetic applicator according to the present invention can suitably be used in lip cosmetics (lipsticks, lip glosses), concealers, and the like, and, although not limited thereto, is particularly suitable for use in lip cosmetics.

REFERENCE SIGNS LIST

1 Cosmetic applicator
2 Support member
3 Application member
3*a* Front end portion
3*b* Rear end portion
3*c* Widest portion
4 Retained portion
5 Retaining hole
6 Inclined surface
6*a* Inclined surface
6*a*'Inclined surface
6*b* Inclined surface
6*b*'Inclined surface
7 Electrostatic flocking
8 Cosmetic container
9 Container body
10 Cap
11 Scraper part

12 Inner hole edge
13 Notch portion
14 Notch portion
15 Pointy portion
16 Notch portion
17 Slit
18 Slit
18*a* Slit
18*b* Slit
19 Central axis

The invention claimed is:

1. A cosmetic applicator, comprising an application member extending from a tip of a rod-like support member at an angle of 0 to 45 degrees with respect to an axial center of the support member, wherein the application member consists of uninterrupted inclined surfaces which are formed in a spiral shape in a direction in which the application member extends, and optionally subjected to electrostatic flocking, and inclined angles of the inclined surfaces with respect to the axial center are constant between a front end of the application member and a rear end of the application member.

2. The cosmetic applicator according to claim 1, wherein a flat surface of the front end of the application member is at an angle of 10 to 120 degrees with respect to a flat surface of the rear end of the application member.

* * * * *